US005688427A

United States Patent [19]

Gallo, Jr.

[11] Patent Number: 5,688,427

[45] Date of Patent: Nov. 18, 1997

[54] MICROWAVE HEATING PACKAGE HAVING END FLAPS FOR ELEVATING AND VENTING THE PACKAGE

[75] Inventor: Anthony J. Gallo, Jr., Omaha, Nebr.

[73] Assignee: ConAgra, Inc., Omaha, Nebr.

[21] Appl. No.: 607,583

[22] Filed: Feb. 27, 1996

Related U.S. Application Data

[62] Division of Ser. No. 255,065, Jun. 7, 1994, Pat. No. 5,510, 132.

[51] Int. Cl.[6] ..... H05B 6/80; A23L 1/01

[52] U.S. Cl. ..... 219/732; 219/729; 219/730; 426/107; 426/234; 99/DIG. 14

[58] Field of Search ..... 219/732, 730, 219/729, 734, 735, 733, 903; 426/107, 234, 122, 123, 243; 99/DIG. 14

[56] References Cited

U.S. PATENT DOCUMENTS

| | | |
|---|---|---|
| 4,096,948 | 6/1978 | Kuchenbecker . |
| 4,190,757 | 2/1980 | Turpin et al. . |
| 4,228,945 | 10/1980 | Wysocki . |
| 4,345,133 | 8/1982 | Cherney et al. . |
| 4,505,391 | 3/1985 | Kuchenbecker . |
| 4,555,605 | 11/1985 | Brown et al. . |
| 4,567,341 | 1/1986 | Brown . |
| 4,592,914 | 6/1986 | Kuchenbecker . |
| 4,612,431 | 9/1986 | Brown et al. . |
| 4,661,671 | 4/1987 | Maroszek . |
| 4,703,148 | 10/1987 | Mikulski et al. . |
| 4,742,203 | 5/1988 | Brown et al. . |
| 4,745,249 | 5/1988 | Daniels . |
| 4,785,160 | 11/1988 | Hart . |
| 4,794,005 | 12/1988 | Swiontek . |
| 4,825,025 | 4/1989 | Seiferth . |
| 4,836,383 | 6/1989 | Gordon et al. . |
| 4,866,232 | 9/1989 | Stone . |
| 4,870,233 | 9/1989 | McDonald et al. . |
| 4,883,936 | 11/1989 | Maynard et al. . |
| 4,891,482 | 1/1990 | Jaeger et al. . |
| 4,916,279 | 4/1990 | Brown et al. . |
| 4,927,991 | 5/1990 | Wendt et al. . |
| 4,940,867 | 7/1990 | Peleg . |
| 4,959,231 | 9/1990 | Lakey et al. . |
| 4,960,598 | 10/1990 | Swiontek . |
| 5,038,009 | 8/1991 | Babbitt . |
| 5,077,455 | 12/1991 | Peleg et al. . |
| 5,095,186 | 3/1992 | Russell et al. . |
| 5,124,519 | 6/1992 | Roy et al. . |
| 5,126,518 | 6/1992 | Beckett . |
| 5,140,119 | 8/1992 | Brown et al. . |
| 5,352,465 | 10/1994 | Gondek et al. . |

OTHER PUBLICATIONS

Photocopy of a package bearing the names Stouffer's and Lean Cuisine French Bread Pizza on its label. The package has a top flap that may be folded under the bottom of the carton and appears to have Oct. 1992 date imprinted thereon. (See lower right hand corner of page 2.).

*Primary Examiner*—Philip H. Leung
*Attorney, Agent, or Firm*—Pretty, Schroeder & Poplawski

[57] ABSTRACT

A microwave heating package for containing a food item to be cooked in a microwave oven including a top wall, a bottom wall and a side wall. A microwave interactive layer is affixed to the bottom wall for converting microwave energy into heat. The side wall is scored to define a first end flap and a second end flap. Each end flap is partially separable from the remainder of the package along the scoring and is hingedly connected to the bottom wall such that the separable portion of each end flap is pivotable from a first unseparated position to a second position located underneath the bottom wall.

17 Claims, 4 Drawing Sheets

FIG. 1
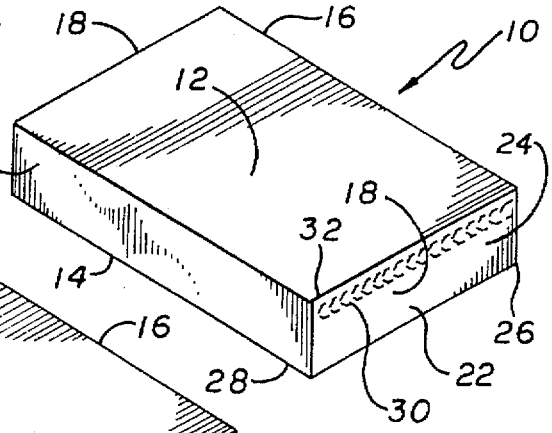
FIG. 2
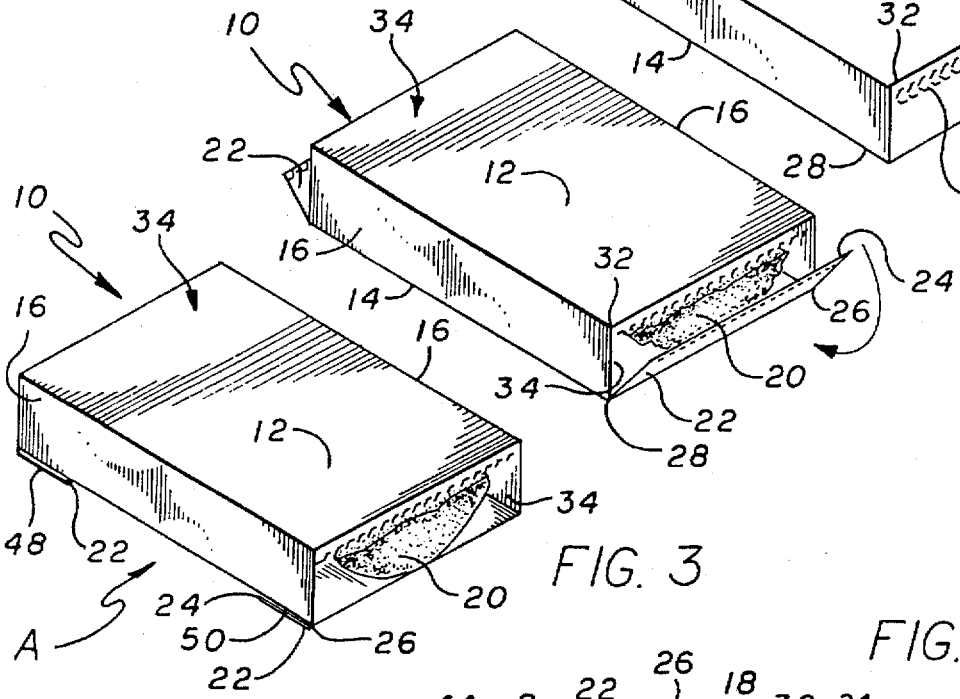
FIG. 3
FIG. 4
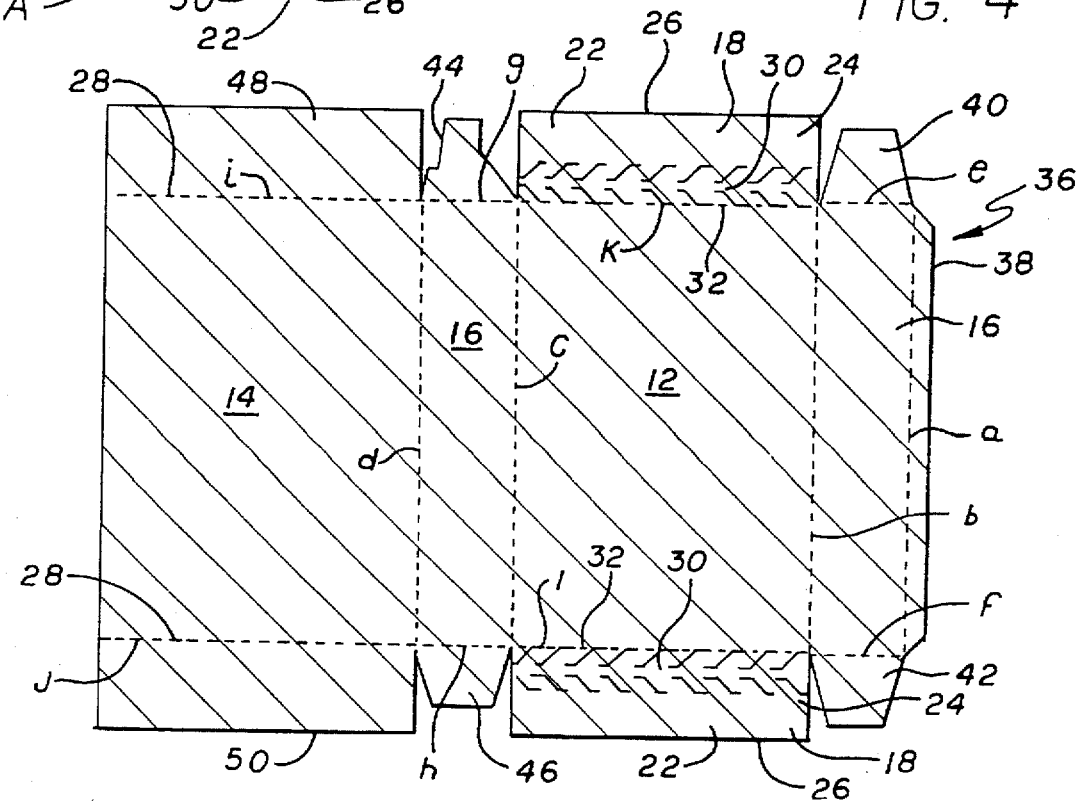

FIG. 5
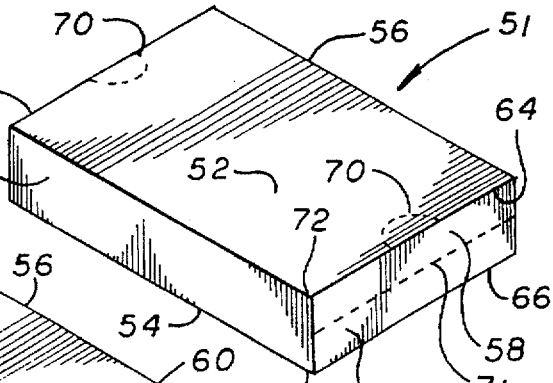
FIG. 6
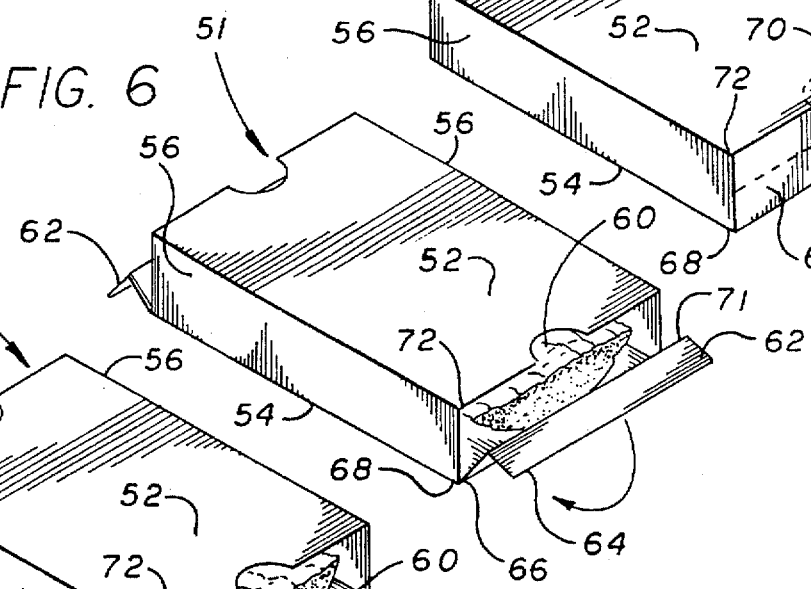
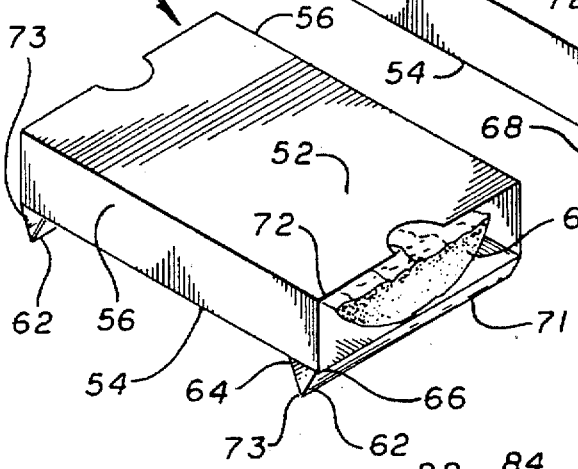
FIG. 7
FIG. 8
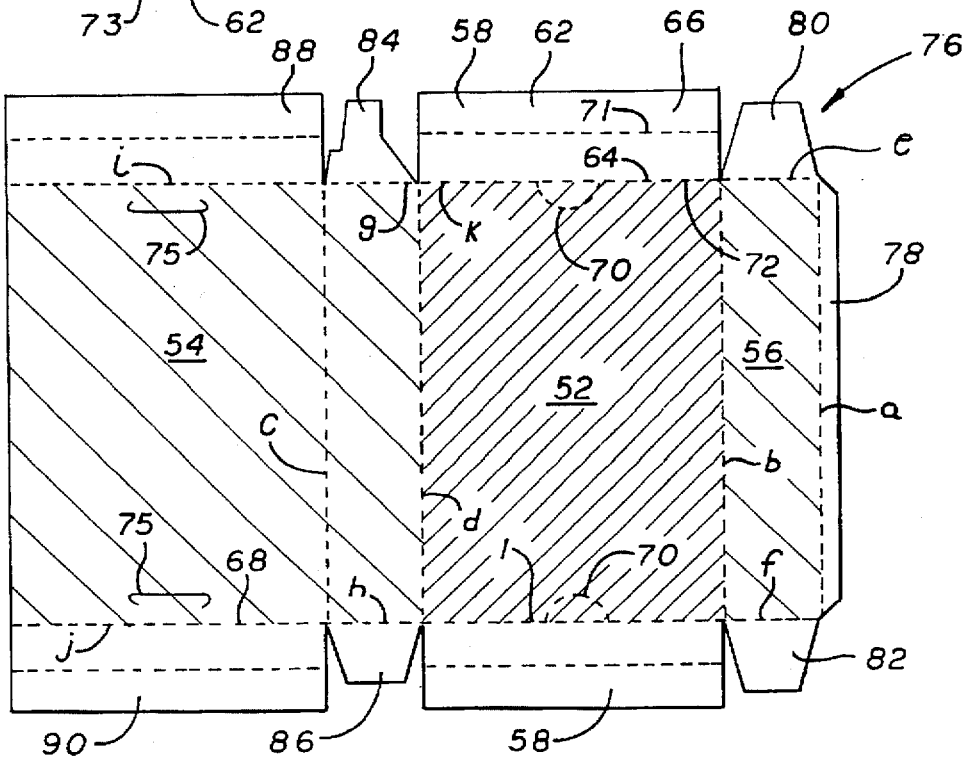

FIG. 9
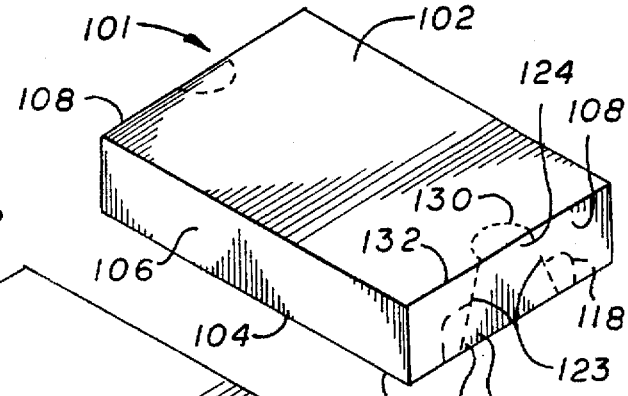
FIG. 10
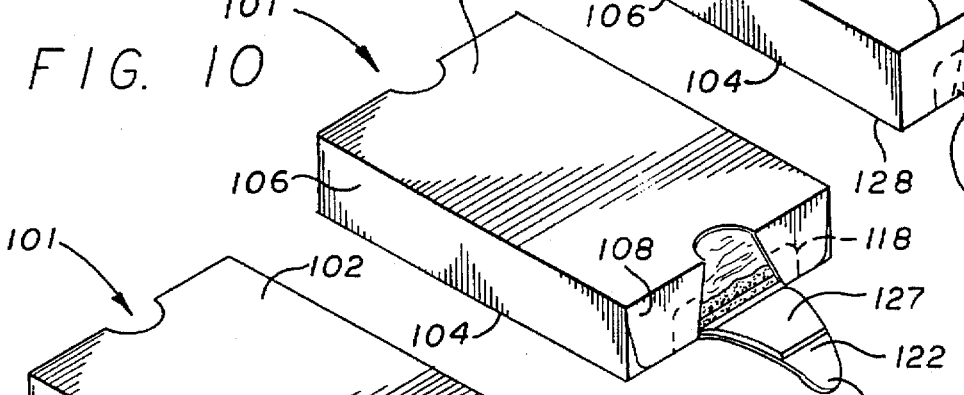
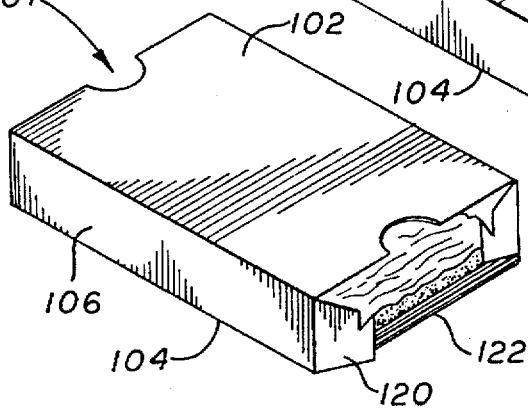
FIG. 11
FIG. 12
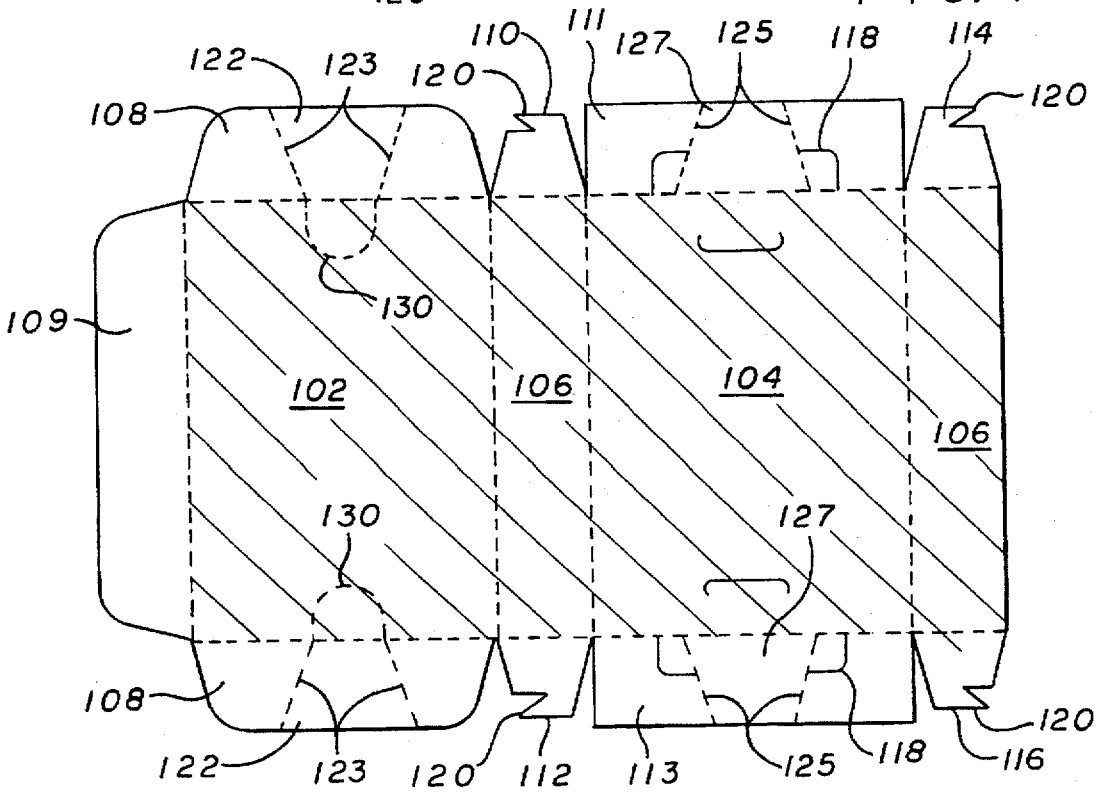

MICROWAVE HEATING PACKAGE HAVING END FLAPS FOR ELEVATING AND VENTING THE PACKAGE

This application is a division of application Ser. No. 08/255,065 filed Jun. 7, 1994 which application is now U.S. Pat. No. 5,510,132.

This invention relates generally to a microwave heating package for food items and, more particularly, to a microwave heating package having end flaps for elevating the package above the microwave oven floor and for venting the package during cooking.

BACKGROUND OF THE INVENTION

The development of microwave cooking has had an enormous impact on food preparation. The high speed with which cooking occurs and the broad array of materials suitable for use in microwave ovens has created an ever-increasing demand for economical, simple, disposable, containers which, when used in a microwave oven, duplicate as closely as possible the cooking results of a conventional oven. The introduction of relatively low cost and reliable microwave interactive materials (sometimes referred to as susceptor materials) has made microwave cooking even more attractive for those food items which require crisping or browning with cooking.

To this end, various specialized packages have been developed to achieve microwave browning or crisping of the food items contained therein. In the case of a pizza-type product, this means that the bottom and side crust must be crisp and its top must be warm and soft. An early concept is suggested in U.S. Pat. No. 4,190,757 to Turpin et al. that utilizes a lower susceptor sheet spaced from the bottom wall of the microwave oven onto which the lower crust portion of a pizza-type product is supported so that the crust portion is heated to a high temperature causing browning and crispness adjacent the lower surface of the crust. Other benefits of the Turpin package are that it is disposable and that it can be used both as a shipping carton suitable for display in a supermarket and as a heating dish to be used by the ultimate consumer. See also, U.S. Pat. Nos. 4,592,914, 4,505,391 and 4,096,948 to Kuchenbecker and U.S. Pat. No. 4,836,383 to Gordon et al. These packages, however, generally have a complicated construction that adds to the manufacture and assembly costs.

In the case of refrigerated and, especially, frozen food products, a substantial volume of water and grease in gaseous form may be released during exposure to microwave energy, which must escape from the package in order to prevent the production of soggy or greasy food. Accordingly, many presently known packages provide for venting. For example, some packages utilize open-ended sleeves during cooking (e.g., U.S. Pat. No. 4,891,482 to Jaeger et al.), while others have vented end portions (e.g., U.S. Pat. No. 4,567,341 to Brown). Again, however, these packages generally have a complicated construction.

Another known carton has a susceptor sheet in the bottom of the carton and has a scored top flap that is sufficiently separable from the remainder of the package to permit it to be folded under the bottom of the carton during cooking in a microwave oven. With this carton, however, the folded top flap merely forms another layer of package material between the bottom of the carton and the microwave oven floor, which may result in heat loss to the oven floor. Additionally, the folded top flap raises one end of the package higher off the microwave oven floor than the other end, which may result in nonuniform cooking. Also, the top of the food item is unshielded during cooking, which in many instances is undesirable.

Despite the proliferation of specialized microwave heating packages, it should be appreciated that there is still a need for an improved package that is economical, simple and disposable and which, especially in connection with a pizza-type product or a bakery item, results in a high quality crisp crust product that is easily accessible and removable. The present invention satisfies this need.

SUMMARY OF THE INVENTION

The present invention is embodied in an economic, simple, disposable, microwave heating package that may be used as a hygienic and safe shipping carton, display carton and cooking vessel. The package is constructed to provide better heating to brown and crisp food items, such as pizza-type products and bakery items, that usually reconstitute poorly in microwave ovens. In particular, the package has end flaps that fold under the package to permit elevated-vented cooking. Using the end flaps to elevate the package creates an air layer between the microwave oven floor and a susceptor layer in the bottom wall of the package. This air layer insulates the susceptor layer from the oven floor, resulting in more heat being forced into the food product above rather than into the oven floor below. Folding the end flaps under the bottom wall also vents the package, which reduces the potential for a soggy product by permitting steam to escape from the package.

The microwave heating package of the present invention includes a top wall, a bottom wall, and a side wall for enclosing the food item between the top and bottom walls. A microwave interactive layer for converting microwave energy into heat may be affixed to the bottom wall. In one embodiment of the invention, the side wall is scored to define a first end flap and a second end flap, each end flap partially separable from the remainder of the package along the scoring. The location of the scoring is sufficient to permit the separable portion of each end flap to be moved to a location underneath the bottom wall.

A feature of the present invention is that the end flaps serve multiple functions, yet have a relatively simple construction. In particular, the flaps vent steam from the package during cooking. The flaps also elevate the bottom of the package from the microwave oven floor during cooking, offering thermal insulation from the oven floor. Previously known packages did not perform these functions as simply and as efficiently.

In one embodiment of the invention, the end flaps are connected to the top wall by perforated zipper strips. Once the zipper strips are torn, the end flaps may be bent 270 degrees to support the package. In another embodiment of the invention, the end flaps are provided with fold lines at one-half the height of the package. Thumb open features on the top wall with perforated scores along the top wall allow the end flaps to be opened, while remaining attached to the bottom wall. Bending each end flap at its fold line permits the formation of a small triangle. The thumb open feature is then pushed into a perforated slot on the bottom wall with the triangles supporting the package above the floor of the microwave oven.

Another feature of the invention is that the package may be constructed of a single sheet of material that may be folded to fully enclose the food item such that the package may be used to ship, display and cook the enclosed product. Such a construction reduces waste, facilitates manufacturing, and increases ease of use, without losing effectiveness.

The invention is also embodied in a method of cooking a food item in a microwave oven, wherein the food item is contained in one of the above packages described above. The method includes the steps of separating the separable portion of each end flap from the remainder of the package along the scoring, placing the separable portion of each end flap underneath the bottom wall of the package, and then cooking the food item in a microwave oven with the separable portion of each end flap underneath the bottom wall.

The present invention is particularly suitable for reconstituting frozen pizza-type products such as French bread pizza, i.e., elongated sections of bread topped with pizza constituents and frozen individually. This well-known frozen food product is prepared by the ultimate consumer by thawing and baking the product in a microwave oven. The invention will be described with particular reference to this mass produced, consumer food product; however, it will be appreciated that the invention has substantially broader applications and may be used for heating or reconstituting various food products of the type having a lower, generally flat, bread portion which is to be heated to a crisp condition preparatory to serving.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

FIG. 1 is a perspective view of a microwave heating package according to the present invention;

FIG. 2 is a perspective view of the package in FIG. 1, wherein the end flaps are shown separated from the top and side walls, after removal of the perforated strips;

FIG. 3 is a perspective view of the package in FIG. 1, wherein the end flaps are shown tucked under the bottom wall, elevating the package;

FIG. 4 is a plan view of the sheet material in FIG. 1, before it is folded;

FIG. 5 is a perspective view of an alternative microwave heating package according to the present invention;

FIG. 6 is a perspective view of the package in FIG. 5, wherein the end flaps are shown separated from the top and side walls;

FIG. 7 is a perspective view of the package in FIG. 5, wherein the end flaps are shown folded into triangular legs for elevating the package;

FIG. 8 is a plan view of the sheet material in FIG. 5, before it is folded;

FIG. 9 is a perspective view of a second alternative microwave heating package according to the present invention;

FIG. 10 is a perspective view of the package in FIG. 9, wherein in the end flaps are shown separated from the top and side walls;

FIG. 11 is a perspective view of the package in FIG. 9, wherein the end flaps are shown tucked under the bottom wall, elevating the package;

FIG. 12 is a plan view of the sheet material in FIG. 9, before it is folded;

DETAILED DESCRIPTION OF THE PREFERRED EMBODIMENTS

Figure 13:
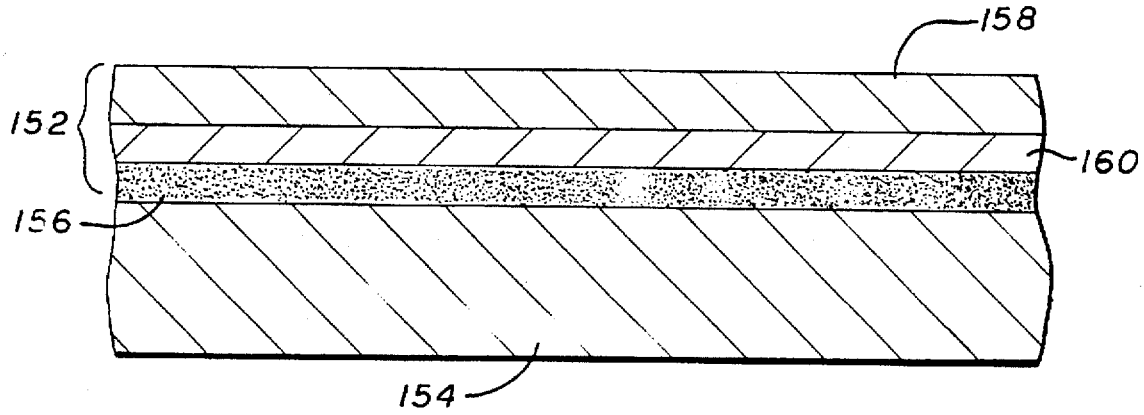
FIG. 13 is a sectional view of the sheet material of FIG. 4.

A microwave heating package 10 embodying the features of the present invention is shown in FIGS. 1–4. The package includes a top wall 12, a bottom wall 14 and a side wall 16 that includes two end walls 18. A food item, such as French bread pizza 20, is provided within the package. The bottom wall serves to receive and support food placed thereon during packaging, shipping, storage, display and cooking periods and, further, includes a microwave interactive material, as will be described later, that converts microwave energy into heat for browning and crisping the surface of the food in contact with the bottom wall of the package. The top wall, bottom wall and side wall also serve to retain food within the package during the various stages through which it passes to protect the food from contamination during these stages.

When the package 10 is used in a microwave oven (not shown) to heat up foods such as refrigerated or frozen pizza-type products or baking items, it is desirable both to provide ventilation to allow moisture vapors to escape from the carton so that the food does not become soggy and to elevate the bottom wall of the package above the floor of the microwave oven, allowing more energy to be forced into the food, not the oven floor. The end walls 18 perform this dual function and additionally serve as the opening feature for removal of the cooked food.

With reference to FIG. 1, each end wall 18 has an end flap 22 having an upper end 24 and a lower end 26. The lower end of each end flap may be hingedly connected to a respective end 28 of the bottom wall 14. The upper end of each end flap is scored, in this case by a perforated zipper strip 30, to facilitate separation from a respective end 32 of the top wall 12. Tearing the zipper strips along their perforations, opens the package and releases the end flaps from the top wall (FIG. 2). The end flaps may then be pivoted about their lower ends 26 to a location underneath the bottom wall, thus elevating the bottom wall above the floor of the microwave oven (FIG. 3). Additionally, the resultant openings 34 at each end of the package created by the movement of the end flaps, provides venting during cooking and permits removal of the cooked food item.

The package 10 may be formed from a single sheet of carton material 36, as shown in FIG. 4. The carton material is formed into a container by folding along fold lines a, b, c, d to form a rectangular sleeve (not shown). A flap 38 may be affixed to the inside surface of the bottom wall 14 by an adhesive, thermal plastic material or other type of suitable mechanical or chemical securing means applied prior to or simultaneously with the folding operation. The container may then be loaded at either end with the food item, after which side tabs 40, 42, 44, 46 are folded along fold lines e, f, g, h and end tabs 48, 50 are folded along fold lines i, j to form the ends of the container. Finally, the end walls 18, having the perforated zipper strips 30, are folded along fold lines k, l and may be affixed to end tabs 48, 50 below the perforated zipper strips to seal the container. It will be appreciated, that, in this embodiment, the end flaps 22 are affixed to the end tabs 48, 50 and are pivotable about the fold lines i, j of the end tabs after removal of the zipper strips.

With reference again to FIGS. 1–3, FIG. 1 shows the package in an assembled condition that is ready for shipment and display. Once purchased, the consumer prepares the package for cooking by grasping and removing each of the perforated zipper strips 30. In so doing, the end flaps 22 are freed from the top wall 12 of the package (FIG. 2). The consumer then rotates the end flaps (and the affixed end tabs 48, 50) 270 degrees, such that the end flaps (and end tabs) are positioned underneath and adjacent to the outside surface of the bottom wall 14 of the package (FIG. 3). The resultant openings 34 in the package serve as venting holes. It will be appreciated that the folded end flaps will raise the bottom wall off the microwave oven floor, creating an insulating air layer between the bottom wall and oven floor.

During the cooking process, the openings 34 allow water vapor to escape from the interior of the container, thereby helping to prevent the cooking food from becoming overly moist or soggy. Additionally, the microwave interactive material in the bottom wall of the package will brown or crisp the surface of the food in contact with the package. Less energy will be lost to the floor of the microwave oven because much, if not all, of the bottom wall is not in contact therewith. Preferably, the middle of the bottom wall of the package at A (See FIG. 3) will be lifted off the floor of the microwave oven, thus providing an insulating layer of air between the bottom wall and the microwave oven floor. With this arrangement, a greater amount of microwave energy will be forced into the middle of the food item, which typically takes the longest to cook, than the ends. After cooking, the package may be easily removed from the microwave oven by hand and the food item 20 may be removed from the package by sliding it out from either vent opening.

With reference now to FIGS. 5–8, an alternative embodiment of a microwave cooking package 51 is shown having a similar construction to the package shown in FIGS. 1–4, except for the ends of the package. The package 51 includes a top wall 52, a bottom wall 54 and a side wall 56 having two end walls 58. A food item, such as french bread pizza 60, is provided within the package.

With reference to FIG. 5, each end wall 58 forms an end flap 62 having an upper end 64 and a lower end 66. The lower end of each end flap may be hingedly connected to a respective end 68 of the bottom wall. The upper end of each end flap is scored, in this case by a perforated thumb tab 70, to facilitate separation from a respective end 72 of the top wall 52. The adjoining edge between the upper end of each end flap and the respective end of the top wall may also be scored in the same manner. Depressing the thumb tabs and breaking the perforations opens the package and releases the end flaps from the top wall (FIG. 6). Each end flap also has a fold line 71 at one-half its height, permitting the end flaps to be bent. Bending the end flaps at their fold lines, while rotating the end flaps 200°–230° about their lower ends, permits the formation of two small triangles 73 for elevating the bottom wall of the package above the floor of the microwave oven (FIG. 7). The thumb tabs may be pushed into perforated slits 75 (see FIG. 8) in the bottom wall to stabilize the triangles.

The package 51 may be formed from a single sheet of carton material 76, as shown in FIG. 8. The carton material is formed into a container by folding along fold lines a, b, c, d to form a rectangular sleeve (not shown). A flap 78 may be affixed to the inside surface of the bottom wall 54. The container may then be loaded with the food item, after which side tabs 80, 82, 84, 86 are folded along fold lines e, f, g, h and end tabs 88, 90 are folded along fold lines i, j to form the ends of the container. Finally, the end walls 58 that are attached to the perforated thumb tabs 70 are folded along fold lines k, 1 and are affixed to the end tabs 88, 90 to seal the container.

With reference now to FIGS. 9–12, a second alternative embodiment 101 is shown having yet another end flap construction. In this embodiment, the package is a conventional top load "kliklok" style having a top wall 102, a bottom wall 104 and a side wall 106 that includes two end walls 108 the package also includes a flap 109, two end tabs 111, 113 and four side tabs 110, 112, 114, 116. The end tabs have slits 118 and the side tabs have hooks 120 for inserting into and interlocking with the slits during the setup operation. Each end wall includes an end flap 122 having an upper end 124 and a lower end 126. The lower end of each end flap may be hingedly connected to a respective end 128 of the bottom wall. The upper end of each end flap is scored for example by a perforated thumb tab 130 at a respective end 132 of the top wall. Each end flap is further delineated by two scored side edges 123 that extend from the thumb tab to the lower end of the end flap. The end tabs 111, 113 may also be provided with scored side edges 125 corresponding to the scored side edges 123 of the end flaps. Depressing the thumb tabs and breaking the perforations along the side edges, opens the package and releases the separable portions 127 of the end tabs and the end flaps 122 from the top wall and end walls (FIG. 10). The separable portions of the end tabs and the end flaps may then be simply pivoted about their lower ends to a location underneath the bottom wall (FIG. 11), similar to that shown in FIGS. 1–4. Alternatively, the end flaps may be provided with fold lines at one-half their height, permitting the end flaps to be formed into small triangles for elevating the bottom wall of the package above the floor of the microwave oven, in the manner illustrated in FIGS. 5–8.

With reference now to FIG. 13, a preferred construction of the carton material is shown to include an inner layer of metalized film 152 that is affixed to an outer layer of paperboard material 154 by an adhesive 156. Paperboard material has a number of desirable characteristics, which makes it ideally suited as the primary structural component of a disposable cook-in microwave container. In particular, paperboard is strong, microwave transparent, easily adapted to receiving advertising display graphics and easily handled during container assembly. Alternatively, other materials, such as plastics, may be used, so long as the construction material does not shield the interior of the carton from the microwave energy.

The metalized layer of film may include a food contacting layer 158 coated by a thin layer of microwave interactive material 160, sometimes referred to as a susceptor material. The food contacting layer is preferably a PET film, which is a stick and grease resistant material. This enables easy removal of cooked food from that surface. The microwave interactive material can be any of those materials, such as aluminum oxide and stainless steel, known to convert a substantial portion of the microwaves which impinge upon it into heat, thereby crisping or browning the food surfaces in contact therewith. Various types of microwave interactive coatings which heat up to brown or crisp food are discussed in U.S. Pat. No. 4,190,757 to Turpin et al.

The layer of microwave interactive material may be applied, for example, by vacuum metalization or sputter metalization. If necessary, the metalized layer of film may be demetalized for patterns. Thin layers of metal may also be incorporated in inks. The metalized layer of film may then be applied to the outer layer of paperboard material by a variety of methods known to those skilled in the art, such as lamination, windowing, printing or press application. In particular, the metalized layer of film can fully cover the paperboard material or portions of the paperboard material can be made without having the metalized layer of film. Various alternatives, which may be variated in many other ways, as desired, are illustrated in FIGS. 4, 8 and 12. In FIG. 4 the sheet of carton material is fully coated with the metalized layer of film (indicated by parallel diagonal lines), whereas in FIGS. 8 and 12, the flap, tabs and end walls are susceptorless. Additionally, in FIG. 8, the top wall 52 is coated with a microwave reflective material instead of the susceptor material.

As indicated above, it may be desirable to coat the top wall of the carton with a microwave reflective material (not shown), which may be a layer of aluminum foil or other type of material having microwave reflective characteristics. This reflective material is used to minimize the amount of microwave energy striking the top of a pizza-type product placed in the package, thus minimizing the likelihood that the pizza topping will become overcooked, dried or burned when the pizza is left in the microwave for a sufficient time to cook the pizza crust.

It will be appreciated from the foregoing description that the present invention provides a microwave cooking package that is economical, easy to use and effective for cooking pizza-type products, or other food items, in a microwave oven. The end flap construction is particularly advantageous in that a consumer, by simply opening the package and locating the end flaps under the bottom wall, elevates the package to obtain improved crispness and browning, vents the package to release moisture and grease, and permits easy removal of the food item after it is cooked.

It will, of course, be understood that modifications to the presently preferred embodiments will be apparent to those skilled in the art. Consequently, the scope of the present invention should not be limited by the particular embodiments discussed above, but should be defined only by the claims set forth below and equivalents thereof.

I claim:

1. A microwave heating package for containing a food item to be cooked in a microwave oven, the package comprising a top wall, a bottom wall, and a side wall for enclosing the food item between the top and bottom walls, the side wall including two opposed end walls, each end wall being scored to define a first end flap between the top and bottom walls and a second end flap between the top and bottom walls, each end flap partially separable from the remainder of the package along the scoring, the location of the scoring sufficient to permit the separable portion of each end flap to move from a position between the top and bottom walls to a position underneath the bottom wall.

2. The microwave heating package of claim 1, further comprising a microwave interactive layer affixed to the bottom wall for converting microwave energy into heat.

3. The microwave heating package of claim 2, further comprising a microwave interactive layer affixed to the top wall for converting microwave energy into heat.

4. The microwave heating package of claim 3, further comprising a microwave interactive layer affixed to the side wall for converting microwave energy into heat.

5. The microwave heating package of claim 4, wherein the microwave interactive layer affixed to the top, bottom and side walls is a continuous microwave interactive layer that forms a sleeve around the food item to be cooked.

6. The microwave heating package of claim 2, further comprising a microwave reflective layer affixed to the top wall.

7. The microwave heating package of claim 2, wherein the end flaps are configured to be spaced from each other when positioned underneath the bottom wall, resulting in an air layer under the bottom wall between the end flaps.

8. The microwave heating package of claim 2, wherein the scoring includes a perforated zipper strip for connecting each end flap to the remainder of the package.

9. The microwave heating package of claim 2, wherein the scoring includes a perforated thumb tab for connecting each end flap to the remainder of the package.

10. The microwave heating package of claim 9, wherein each end flap has a fold line for folding the end flap and the bottom wall has a pair of slits for receiving the thumb tabs, the fold lines and slits being arranged such that the end flaps may form a pair of stabilized triangles located underneath the bottom wall for elevating the bottom wall above the floor of the microwave oven.

11. A microwave heating package comprising a single sheet of carton material folded into a container for enclosing a food item, the container having a top wall, a bottom wall parallel to the top wall and a side wall extending between the top and bottom walls, the side wall including two opposed end walls, a microwave interactive layer affixed to the bottom wall of the container for converting microwave energy into heat, each end wall being scored to define an end flap between the top and bottom walls that is partially separable from the remainder of the package along the scoring and that is hingedly connected to the bottom wall, the location of the scoring sufficient to permit the separable portion of each end flap to move from a position between the top and bottom walls to a position underneath the bottom wall.

12. The microwave heating package of claim 11, further comprising a microwave reflective layer affixed to the top wall.

13. The microwave heating package of claim 11, further comprising a microwave interactive layer affixed to the top and side walls and wherein the microwave interactive layer affixed to the top, bottom and side walls is a continuous microwave interactive layer that forms a sleeve around the food item to be cooked.

14. The microwave heating package of claim 11, wherein the end flaps are configured to be spaced from each other when positioned underneath the bottom wall, resulting in an air layer under the bottom wall between the end flaps.

15. The microwave heating package of claim 11, wherein the scoring includes a perforated zipper strip for connecting each end flap to the remainder of the package.

16. The microwave heating package of claim 11, wherein the scoring includes a perforated thumb tab for connecting each end flap to the remainder of the package.

17. The microwave heating package of claim 16, wherein each end flap has a fold line for folding the end flap and the bottom wall has a pair of slits for receiving the thumb tabs, the fold lines and slits being arranged such that the end flaps may form a pair of stabilized triangles located underneath the bottom wall for elevating the bottom wall above the floor of the microwave oven.

* * * * *